United States Patent [19]

Moore et al.

[11] 3,962,781

[45] June 15, 1976

[54] ELECTROMAGNETIC WAVEGUIDES

[75] Inventors: Alexander Joseph Moore, Marlow; David Alexander Taylor, Kenton; David James Greene, Harrow, all of England

[73] Assignee: BICC Limited, London, England

[22] Filed: Mar. 25, 1975

[21] Appl. No.: 562,000

[30] Foreign Application Priority Data

Mar. 29, 1974 United Kingdom ..... 14174/74

[52] U.S. Cl. ..... 29/600; 29/203 D; 156/180; 156/431

[51] Int. Cl.[2] ..... H01P 11/00

[58] Field of Search ..... 29/600, 203 R, 203 D, 29/430, 33 D, 33 P; 156/50, 51, 52, 53, 56, 180, 428, 429, 430, 431; 264/272, 209, 267; 425/113, 131, 133; 138/122, 127, 174, 130, 131, DIG. 2, DIG. 10; 57/9; 333/95 R, 95 A, 98 R, 98 BE; 72/135, 146, 368, 370; 214/1 BA; 198/19, 277 R, 277 T

[56] References Cited

UNITED STATES PATENTS

| | | | |
|---|---|---|---|
| 3,012,092 | 12/1961 | Whearley et al. | 156/53 |
| 3,422,215 | 1/1969 | Humes | 156/53 |
| 3,635,255 | 1/1972 | Kramer | 138/122 |
| 3,769,697 | 11/1973 | Priaroggia et al. | 29/600 |
| 3,779,846 | 12/1973 | Kleykamp et al. | 156/144 |
| 3,845,549 | 11/1974 | Ferrentino | 29/600 |
| 3,861,352 | 1/1975 | Hammer | 198/177 R |

*Primary Examiner*—C.W. Lanham
*Assistant Examiner*—James R. Duzan
*Attorney, Agent, or Firm*—Buell, Blenko, & Ziesenheim

[57] ABSTRACT

A rigid electromagnetic waveguide is manufactured in a continuous series of operations by causing an elongate mandrel, supported vertically, to travel along a predetermined path successively to a wire-winding station where a layer of closely wound helical turns of wire is applied; a station or stations where a layer or layers of resin-impregnated reinforcing elements to form a reinforcing wall is or are applied; a curing station where the resin is cured; and an extraction station where the waveguide is removed from the mandrel. Between the last of the stations where a layer of the reinforcing wall is formed and the curing station, the mandrel may pass through stations where a moisture barrier and an outer protective covering are applied. Risk of change in tension in the wires or reinforcing elements about the neutral axis of the waveguide is reduced.

27 Claims, 8 Drawing Figures

ELECTROMAGNETIC WAVEGUIDES

This invention relates to electromagnetic waveguides for use in effecting communication over long distances by conveying micro wave signals along waveguides arranged continuously along an appropriate transmission path.

The invention is particularly concerned with substantially rigid electromagnetic waveguides of the kind including a layer of helically wound wire and, surrounding the layer of wire, a reinforcing wall comprising at least one layer of glass fibre or other suitable elongate reinforcing element bonded with resin. For convenience, all such glass fibres and other elongate reinforcing elements will hereinafter be included in the expression "reinforcing elements".

It is an object of the present invention to provide an improved method of manufacturing a substantially rigid electromagnetic waveguide of the aforesaid kind which can be effected as a substantially continuous series of operations and which employs substantially less floor space than presently known methods of manufacture.

According to the invention the method comprises suspending or otherwise supporting an elongate mandrel with its axis substantially vertical and causing the mandrel so supported to travel along a predetermined path successively to a wire-winding station where a layer of closely wound helical turns of wire is applied over at least a major part of the length of the mandrel, a station or stations where a layer or layers of resin-impregnated reinforcing elements is or are formed over the layer of wire, a curing station where the layer or layers of resin-impregnated reinforcing elements is or are cured, and an extraction station where the waveguide so formed is removed from the substantially vertical mandrel.

Preferably, in passing between the station or stations, or the last of the stations, at which a layer or layers of resin-impregnated reinforcing elements is or are formed and the curing station, the substantially vertical mandrel is caused to travel through or past a station at which a moisture barrier is applied over the layer or outermost layer of resin-impregnated reinforcing elements, and a station at which an outer protective covering is applied over the moisture barrier. Preferably, also, the predetermined path along which the substantially vertical mandrel is caused to travel is endless, the mandrel travelling from the extraction station to a mandrel-cleaning station and from the mandrel-cleaning station back to the wire-winding station. Where the viscosity of the resin impregnating the reinforcing elements is such that it is preferable that the mandrel carrying the layer of helically wound wire is heated before the layer or layers of resin-impregnated reinforcing elements is or are applied, in passing from the wire-winding station to the station, or to the first of the stations, at which a layer of resin-impregnated reinforcing elements is formed, the mandrel carrying the layer of helically wound wire may pass through or past a warming station where it is heated.

Manufacture of a substantially rigid electromagnetic waveguide on an elongate mandrel that is suspended or otherwise supported with its axis substantially vertical has the important advantage that there is substantially no risk of change in tension in the wire and in the reinforcing elements of the reinforcing layer or layers about the neutral axis of the waveguide, which might otherwise occur where the wire and reinforcing elements are applied to an elongate mandrel arranged substantially horizontally and supported at or near its ends. Since by the method of the present invention there is substantially no change in tension in the wire and in the reinforcing elements throughout the length of the waveguide, there is less tendency for distortion of the waveguide to occur when the waveguide is supported horizontally.

The mandrel is preferably freely suspended from an overhead carriage which can be caused to travel along an overhead track extending between the several operating stations.

At each of the mandrel-cleaning station, the wire-winding station, the station or stations at which a layer or layers of resin-impregnated reinforcing elements is or are formed, the station at which a moisture barrier is applied and the station at which an outer protective covering is applied, preferably the substantially vertical mandrel is held substantially rigid during the operation at said station, but without preventing rotation of the mandrel.

The invention also includes apparatus for use in the manufacture of a substantially rigid electromagnetic waveguide of the aforesaid kind, which apparatus comprises an overhead track; a plurality of carriages adapted to travel along the track and each having means for supporting an elongate mandrel with its axis substantially vertical; and, at spaced positions along the route of and below the overhead track, a wire-winding station at which apparatus is provided for helically winding a layer of wire on to a mandrel, a station or stations at which means is provided for forming on a layer or wire on a mandrel a layer or layers of resin-impregnated reinforcing elements, a curing station at which apparatus is provided for curing the layer or layers of resin-impregnated reinforcing elements on a mandrel or mandrels, and an extraction station at which apparatus is provided for removing a waveguide from a mandrel.

Preferably the apparatus also includes, between the station or stations, or the last of the stations, at which means is provided for forming a layer or layers of resin-impregnated reinforcing elements and the curing station, a station at which there is provided apparatus for applying over the layer or outermost layer of resin-impregnated reinforcing elements a moisture barrier and a station at which there is provided apparatus for applying over the moisture barrier — an outer protective covering. A mandrel-warming station may be provided between the wire-winding station and the station, or the first of the stations, at which a layer of resin-impregnated reinforcing elements can be formed.

The overhead track is preferably endless and there is provided between the extraction station and the wire-winding station a mandrel-cleaning station at which means is provided for thoroughly cleaning a mandrel before it is passed again to the wire-winding station.

Each carriage or other device from which a mandrel can be freely suspended may be caused to travel along the overhead track by manual operation or there may be provided along the track a continuously moving chain with which means carried by a carriage may be engaged or disengaged as required.

At each of the mandrel-cleaning station, the wire-winding station, the station or stations at which a layer or layers of resin-impregnated reinforcing elements can be formed, the station at which a moisture barrier can be applied and the station at which an outer protective covering can be applied, preferably means is provided for holding a mandrel substantially rigid during the operation to be effected at said station, but without preventing rotation of the mandrel.

The layer of wire may be formed by helically winding a single wire around the substantially vertical mandrel but, with a view to reducing the time otherwise incurred in forming the layer of wire, it is preferred to wind concurrently two or more wires around the mandrel under substantially constant tension.

The wire may be of circular or non-circular cross-section and in the latter case is preferably of substantially rectangular cross-section. The wire may have a covering layer of insulating material, e.g. an insulating enamel, or it may be bare. Where the wire is bare, after the waveguide has been removed from the mandrel a layer of insulating material will generally be applied to the internal surface of the waveguide.

The reinforcing wall built up of resin-impregnated reinforcing elements may take any one of several different forms. In one embodiment of the invention the substantially vertical mandrel passes from the wire-winding station to apparatus at which one or more than one layer of reinforcing elements is helically wound around the layer of wire on the mandrel, the reinforcing elements being impregnated with resin in passing from a source of supply under substantially constant tension to the mandrel. Where two or more layers of helically wound resin-impregnated reinforcing elements are applied to the mandrel the directions of lay of adjacent layers are preferably of opposite hand. In an alternative embodiment of the invention the substantially vertical mandrel carrying a layer of wire passes from the wire-winding station to apparatus where there is applied to the mandrel at least one layer of reinforcing elements which extend lengthwise of the mandrel, preferably substantially parallel to its axis. The mandrel subsequently passes to apparatus where the layer or layers is or are impregnated with resin. A method of and apparatus for applying reinforcing elements longitudinally to a mandrel is the subject of our co-pending U.S. patent application Ser. No. 562,000, filed on Mar. 25th, 1975. Preferably, in this latter case the mandrel with one or more than one layer of longitudinally extending resin-impregnated reinforcing elements passes to apparatus where at least one layer of helically wound resin-impregnated reinforcing elements is applied overall.

The reinforcing elements will generally, but not necessarily, comprise glass fibers but, in some instances, at least some of the reinforcing elements may comprise wires, tapes of suitable reinforcing material or tapes in which, or on a surface of which, wires, fibers, filaments or other elongate reinforcing elements are secured.

Where it is required for the layer of helically wound wire to be immediately surrounded by a layer or layers of lossy material, such lossy layer or layers may be formed by incorporating graphite or other electrically conductive material in the resin of at least the innermost layer or inner layers of resin-impregnated reinforcing elements.

At the station where a moisture barrier is applied, the moisture barrier is preferably formed by wrapping transversely around the reinforcing wall on the mandrel a sheet of metal or metal alloy, for example aluminium. The folded metallic sheet is preferably retained in place by applying at least one layer of helically wound resin-impregnated fibrous tape over the screen (at the same station or at an additional station). Preferably over a part of the length of the mandrel adjacent each of its ends several layers of resin-impregnated fibrous tape are applied to form end parts of an external diameter greater than the remaining part of its length, said end parts being subsequently ground or otherwise formed into a shape and size suitable for effecting a joint with an end of another waveguide.

The curing station preferably comprises an oven, or two or more ovens, which or each of which will accommodate a plurality of substantially vertical mandrels. Where two or more ovens are provided the overhead track will include, associated with each oven, a by-pass whereby, where necessary, a mandrel can be caused to by-pass an oven.

Removal of a waveguide from a substantially vertical mandrel is preferably effected by causing relative longitudinal movement between the mandrel and the waveguide. Preferably the mandrel is maintained stationary and the waveguide is pushed downwardly off the mandrel into a substantially vertical hole in the floor beneath the mandrel because such an arrangement avoids the necessity for providing an excessively high clearance that would otherwise be needed above the overhead track in the region where the mandrel is to be extracted from the waveguide. After the waveguide has been removed from the mandrel the mandrel can be transferred to the mandrel-cleaning station and the waveguide removed from the hole.

After a waveguide has been removed from the hole in the floor it can be transported to another part of the factory where the waveguide can be cut to a predetermined length and the outer surfaces of the enlarged end parts of the waveguide can be ground or otherwise formed to a shape and size suitable for effecting a connection with an end of another waveguide. Preferably the end parts of the waveguide are ground to such a cross-sectional shape and size that the ends of two waveguides will be tight fits in the opposite end of a substantially rigid sleeve having a bore of complementary cross-section, preferably a sleeve of resin-impregnated reinforcing elements. Each connection between an end of a waveguide and an end of a sleeve is preferably secured by a suitable adhesive, for instance an epoxy resin. To provide fluid-tight seals between an end part of a waveguide and the surrounding part of a sleeve, the outer surface of the end part may be formed with at least one peripheral groove into which adhesive can be introduced through an appropriately positioned aperture in the wall of the sleeve.

The invention is further illustrated by a description, by way of example, of the preferred method of, and apparatus for use in, manufacture of a substantially rigid electromagnetic waveguide of circular cross-section with reference to the accompanying drawings, in which.

Figure 1:
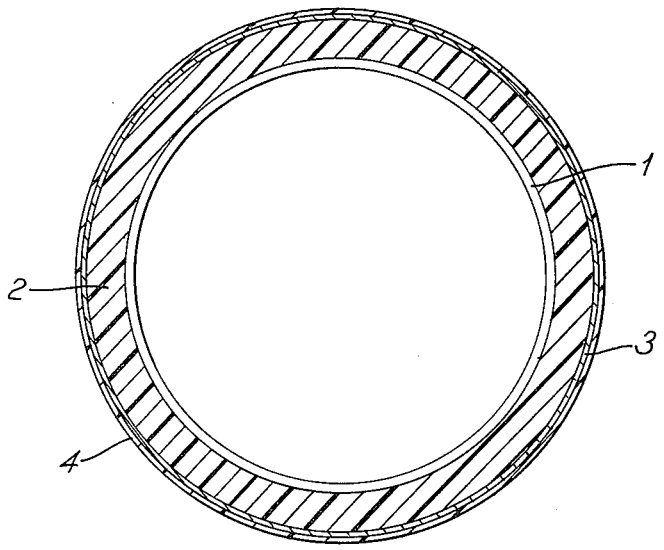
FIG. 1 is a cross-sectional end view of the electromagnetic waveguide to be manufactured.

Referring to FIG. 1, the preferred substantially rigid electromagnetic waveguide manufactured by the method described with reference to FIGS. 2 to 7 comprises a layer 1 of helically wound enamel-coated copper wire, a reinforcing wall 2 comprising a plurality of layers of helically wound glass fibers bonded with resin, a moisture barrier 3 formed of a transversely folded sheet of aluminium, and an outer protective covering 4 comprising a plurality of layers of helically wound glass fiber tape bonded with resin. The waveguide has an internal diameter of 50.0 mm and an external diameter of 59.5 mm.

Figure 2:
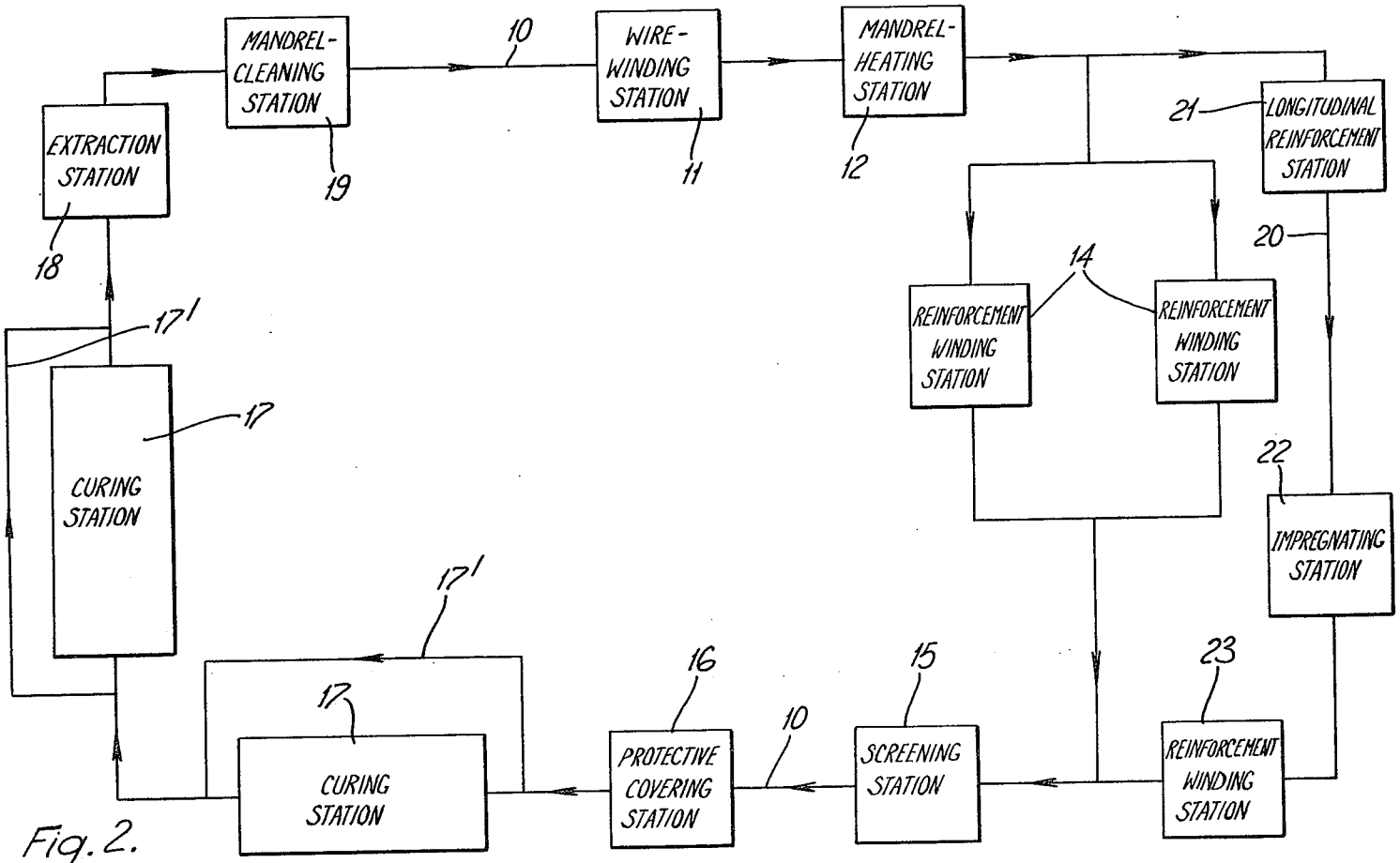
FIG. 2 is a diagrammatic representation of the layout of the apparatus.
Figure 4:
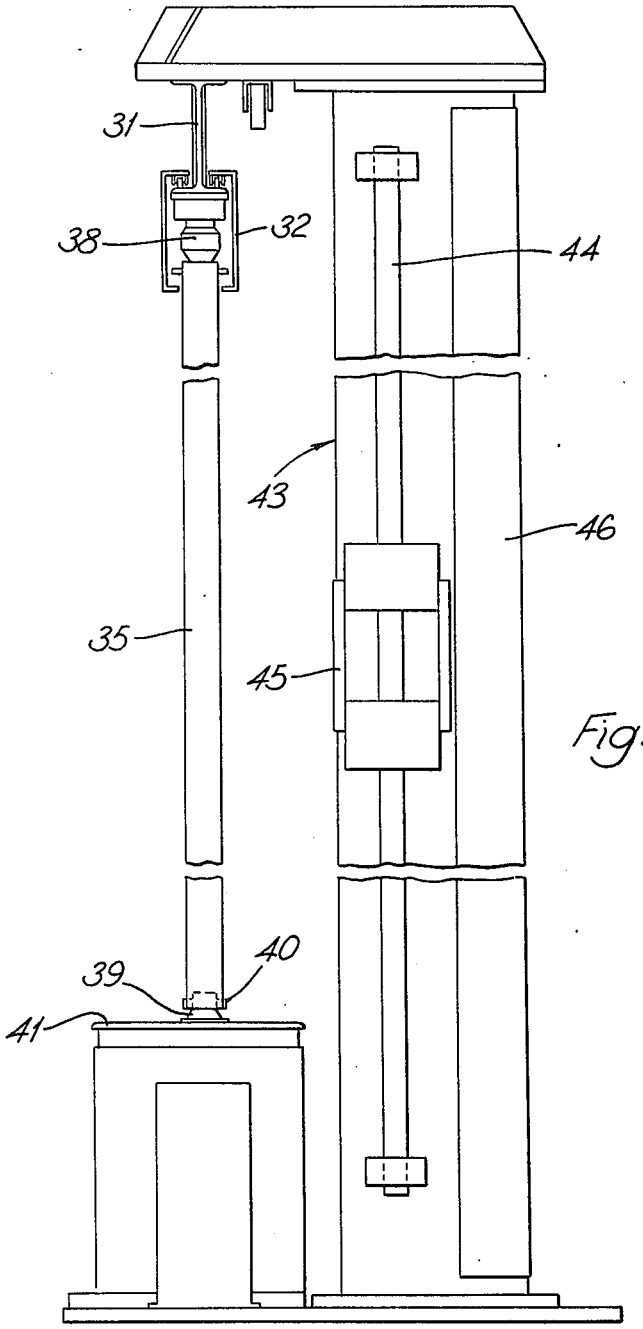
FIG. 4 is a sectional side view of one station of the apparatus.

As will be seen on referring to the diagrammatic representation of the apparatus shown in FIG. 2, the apparatus comprises an endless overhead track 10 along which can be moved manually in succession a plurality of carriages (not shown) from each of which an elongate tubular mandrel of circular cross-section can be suspended with its axis substantially vertical. The mandrel has an external diameter of 50.00 mm and has a length of 3.5 m.

Positioned at intervals around the track 10 are a wire-winding station 11; a mandrel-heating station 12; two stations 14, in parallel, at which glass fibers that have been pre-impregnated with resin are helically wound about a mandrel; a barrier station 14 where a sheet of aluminium is transversely folded around the mandrel; a station 16 where an outer protective covering of resin-impregnated glass fiber tape is applied over the barrier, two curing ovens 17, each capable of accommodating thirty substantially vertical mandrels, associated with each of which curing ovens is a by-pass route 17' interconnected in the overhead track 10; an extraction station 18 at which the waveguide is removed from the mandrel; and a mandrel-cleaning station 19.

The overhead track 10 also includes, after the mandrel-heating station 12, an alternative route 20 along which there are located a station 21 at which glass fibres are applied longitudinally to a mandrel; a station 22 at which the layer or layers of longitudinally extending glass fibers is or are impregnated with resin; and a station 23 at which at least one layer of helically wound resin-impregnated glass fibers is applied over the layer or layers of longitudinally extending glass fibers.

Figure 3:
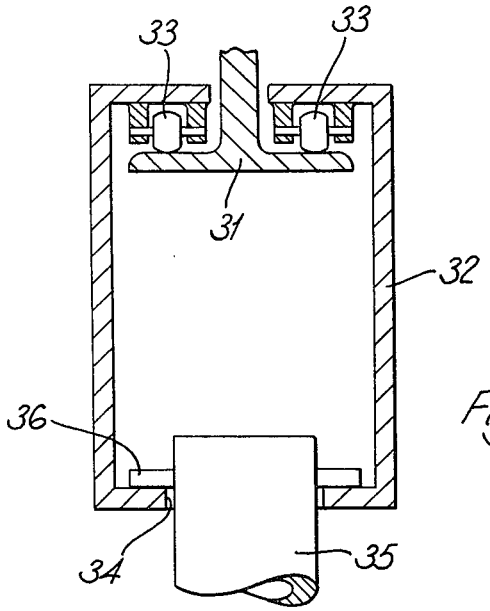
FIG. 3 is a fragmental cross-sectional end view of the endless track and a carriage of the apparatus.

As is shown in FIG. 3, the overhead track 10, 20 comprises a continuous girder 31, of I-shaped cross-section which is supported at a height of approximately 4 metres above the floor. Adapted to travel around the overhead track 10, 20, are seventy carriages 32, each of which is supported on wheels 33 which run on the upper surface of the lowermost flange of the I-shaped girder 31. In the lowermost wall of the carriage 32 is a hole 34 through which one end of a tubular mandrel 35 can pass, the mandrel having at this end a transversely extending bar 36 which rests on the upper surface of the lowermost wall of the carriage so that the mandrel is freely supported. The carriage 32 with the mandrel 35 suspended from it can be moved along the track from station to station by hand.

At each of the wire-winding station 12, the stations 14 and 23 at which resin-impregnated glass fibers are helically wound about a mandrel, the station 16 where resin-impregnated glass fiber tape is helically wound about a mandrel and the mandrel-cleaning station 19, means is provided for maintaining a mandrel substantially rigid. As will be seen on referring to FIG. 4, this means comprises a fixed upper spigot 38 which depends from the I-shaped girder 31 at the station and, in axial alignment with and spaced from the fixed spigot, a lower spigot 39 mounted on a table 41, which can be raised or lowered by a motor (not shown) so that a tubular mandrel 35 can be held substantially rigid between the spigots 38 and 39 which engage in the open ends of the mandrel. The table 41 can be rotatably driven about the axis of the spigot 39 and the spigot 39 has a transversely extending bar 40 which engages in a pair of slots in the lower end of the mandrel 35, the arrangement being such that when the table 41 and spigot 39 are rotatably driven the substantially rigid mandrel is rotatably driven about its longitudinal axis.

Adjacent the aligned spigots 38 and 39 is a substantially vertical frame 43 supporting a shaft 44 on which is mounted a support 45 which can be driven up and down the shaft by a chain drive mounted in the housing 46. The support 45 carries the apparatus appropriate to the station at which the vertical frame is positioned. At the wire-winding station 12 the support 45 carries a device for guiding two wires under substantially constant tension from a source of supply to a mandrel 35 held substantially rigid at the station so that the two wires are helically wound side by side around the mandrel as the mandrel is rotatably driven about its axis and the support is driven from one end of the frame 43 to the other. At each of the stations 14 and 23 the support 45 carries a device for guiding a plurality of glass fibers under substantially constant tension from a source of supply through a body of resin in a liquid state carried by the support to a mandrel held substantially rigid at the station so that resin-impregnated glass fibers are helically wound around the mandrel as the mandrel is rotatably driven about its axis and the support is driven back and forth from one end of the frame to the other. At the station 16 the support 45 carries a device for guiding a glass fiber tape under substantially constant tension from a source of supply through a body of resin in a liquid state carried by the support to a mandrel 35 held substantially rigid at the station so that resin-impregnated glass fiber tape is helically wound around the mandrel as the mandrel is rotatably driven about its axis and the support is driven back and forth from one end of the frame to the other. Over a part of the length of the mandrel 35 adjacent each of its ends several layers of resin-impregnated fibrous tape are applied to form end parts 5 (FIGS. 7 and 8) of an external diameter greater than the remaining part of the length of the covering. At the mandrel-cleaning station 19 the support 45 carries a buffer or other cleaning device which bears against the surface of a mandrel 35 held substantially rigid at the station so that the mandrel is cleaned as it is rotatably driven about its axis and the buffer is driven from one end of the frame 43 to the other.

Figure 5:
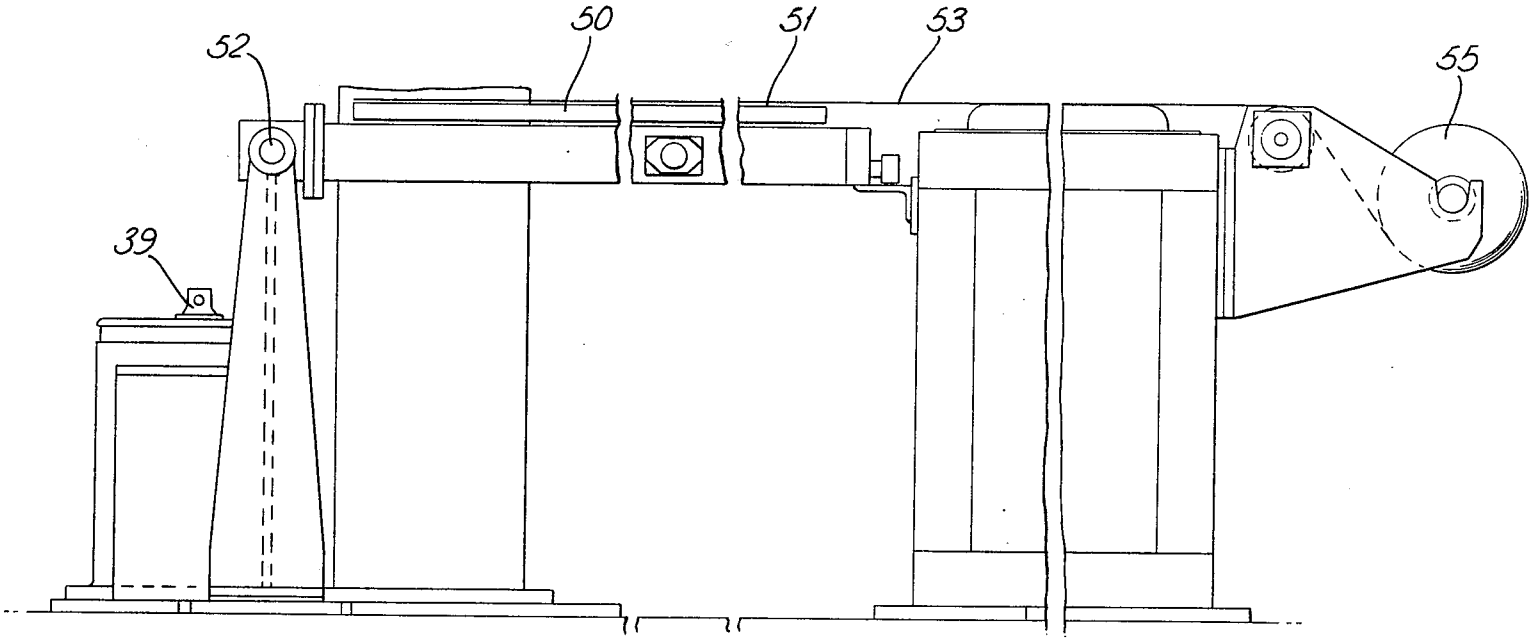
FIG. 5 is a plan view of the station of the apparatus at which a moisture barrier is applied.
Figure 6:
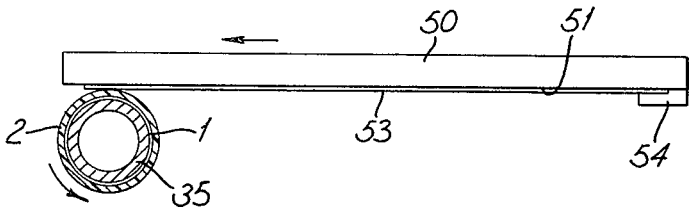
FIG. 6 is a diagrammatic cross-sectional view of the apparatus shown in FIG. 5 illustrating how the moisture barrier is applied.

The moisture barrier 3 is applied about the reinforcing wall 2 built up on a mandrel 35 at station 15 by the apparatus shown in FIGS. 5 and 6. This apparatus comprises a fixed upper spigot and a rotatably driven, vertically adjustable lower spigot 39 for holding a mandrel at station 15 substantially rigid and a substantially horizontal table 50 which can be caused to pivot about a horizontal axis 52 so that the surface 51 of the table lies in a substantially vertical plane that is tangential to a mandrel 35 held substantially rigid at the station. A sheet 53 of aluminium wound from a roll 55 is laid on the surface 51 of the table 50 and the table is caused to pivot about the axis 52 so that the surface lies in said tangential plane, the aluminium sheet 53 being held against the surface 51 by suction or pneumatic means 54. The substantially vertically disposed table 50 is now moved in said tangential plane towards the mandrel to effect contact between the aluminium sheet 53 and the outermost layer of resin-impregnated glass fiber 2 on the mandrel so that the sheet adheres to the layer. The mandrel 35 is rotatably driven about its axis and the table 50 moved tangentially with respect to the mandrel to peel the aluminium sheet 53 from the table and cause it to be wrapped around the reinforcing wall 2 on the mandrel.

Figure 7:
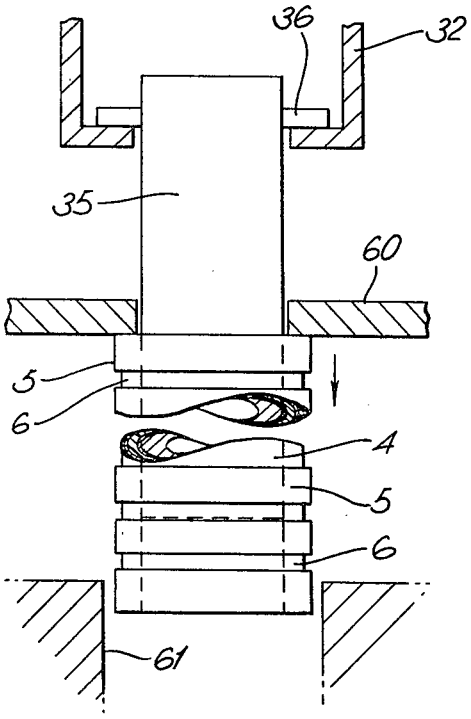
FIG. 7 is a fragmental diagrammatic side view of the extraction station of the apparatus.

As will be seen in referring to FIG. 7, at the extraction station 18 an ejector 60 is caused to engage the end face of the upper end part 5 of the outer protective covering 4 on a substantially vertical mandrel 35 positioned at the station and the ejector is driven vertically downwards to push the waveguide off the mandrel into a substantially vertical hole 61 in the ground. Since the waveguide is subsequently cut to a predetermined length and the end parts 5 of the outer protective covering 4 are ground for effecting a joint with another waveguide there is no risk of damage to the waveguide during the extraction operation.

Figure 8:
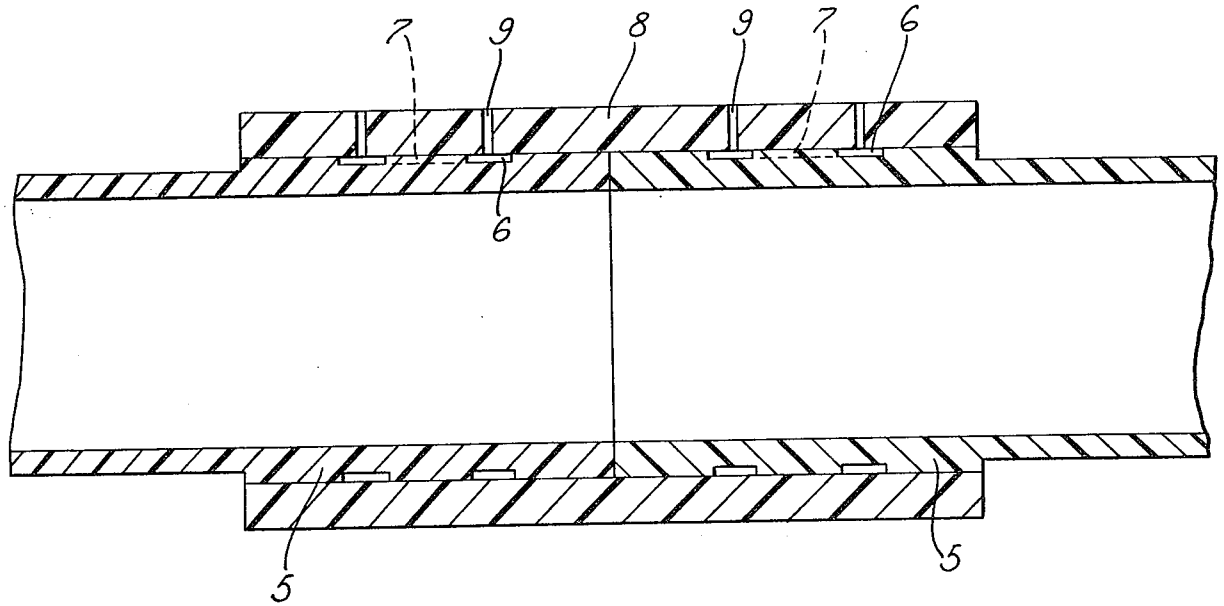
FIG. 8 is a sectional side view of the preferred method of effecting a joint between two electromagnetic waveguides made by the apparatus as described with reference to FIGS. 2 to 7.

After waveguides have been so formed each waveguide is cut to a predetermined length, the end parts 5 of the outer protective covering 4 are ground to the required diameter and, as shown in FIG. 8, two annular grooves 6 are cut in the end parts. A groove 7 is also cut to extend between the annular grooves 6.

A joint between two waveguides is effected by introducing one end part 5 of both waveguides into opposite ends of a preformed sleeve 8 of resin bonded glass fiber, which is a tight fit over end parts 5, so that the end parts 5 abut at approximately the mid-point of the sleeve. The sleeve 8 has in its wall four apertures 9 which are so positioned as to overlie the annular grooves 6 in the end parts 5 of the waveguides. Epoxy resin is injected into each of the apertures 9 to flow into the grooves 6 and 7 and, on setting, the epoxy resin effects a watertight joint between the waveguides.

What we claim as our invention is:

1. A method of manufacturing a substantially rigid electromagnetic wavelength which comprises supporting an elongate mandrel with its axis substantially vertical and causing the mandrel so supported to travel along a predetermined path successively to a wire-winding station where a layer of closely wound helical turns of wire is applied over at least a major part of the length of the mandrel, a station where a layer of resin-impregnated reinforcing elements is formed over the layer of wire, a curing station where the layer of resin-impregnated reinforcing elements is cured, and an extraction station where the waveguide so formed is removed from the substantially vertical mandrel.

2. A method of manufacturing a substantially rigid electromagnetic waveguide which comprises supporting an elongate mandrel with its axis substantially vertical and causing the mandrel so supported to travel along a predetermined path successively to a wire-winding station where a layer of closely wound helical turns of wire is applied over at least a major part of the length of the mandrel, a station where a layer of resin-impregnated reinforcing elements is formed over the layer of wire, a station where a moisture barrier is applied over the layer of resin-impregnated reinforcing elements, a station where an outer protective covering is applied over the moisture barrier, a curing station where the layer of resin-impregnated reinforcing elements, and where necessary the outer protective covering, is cured, and an extraction station where the waveguide so formed is removed from the substantially vertical mandrel.

3. A method as claimed in claim 1, wherein the predetermined path along which the substantially vertical mandrel is caused to travel is endless, the mandrel travelling from the extraction station back to the wire-winding station.

4. A method as claimed in claim 3, wherein the mandrel, in travelling from the extraction station to the wire-winding station, travels past a mandrel-cleaning station.

5. A method as claimed in claim 1, wherein the mandrel, in travelling from the wire-winding station to the station, at which a layer of resin-impregnated reinforcing elements is formed, travels through a warming station where it is heated.

6. A method as claimed in claim 1 wherein, during travel along said predetermined path, the mandrel is freely suspended from an overhead carriage which can be caused to travel along an overhead track extending between the several operating stations.

7. A method as claimed in claim 2, wherein at each of the wire-winding station, the station at which a layer of resin-impregnated reinforcing elements is formed, the station at which a moisture barrier is applied and the station at which an outer protective covering is applied, the substantially vertical mandrel is held in such a way that it is substantially rigid but is rotatable about its axis during the operation at said station.

8. A method as claimed in claim 7, wherein the layer of resin-impregnated reinforcing elements is formed over the layer of wire by feeding a plurality of reinforcing elements from a source of supply under substantially constant tension towards the wire covered mandrel impregnating the advancing reinforcing elements with resin and rotatably driving the substantially rigid mandrel about its longitudinal axis to wind said resin impregnated reinforcing elements helically around the wire-covered mandrel.

9. A method as claimed in claim 7, wherein the layer of resin-impregnated reinforcing elements is formed over the layer of wires by applying around the layer of wire on the substantially rigid mandrel a plurality of reinforcing elements which extend lengthwise of the mandrel and subsequently impregnating said longitudinally extending reinforcing elements a metallic sheet.

10. A method as claimed in claim 9, wherein at least one layer of helically wound resin-impregnated reinforcing elements is applied over the layer of layers of longitudinally extending resin-impregnated reinforcing elements.

11. A method as claimed in claim 7, wherein said moisture barrier is formed by wrapping a metallic sheet transversely around the reinforcing wall.

12. A method as claimed in claim 7, wherein the outer protective covering is applied over the moisture barrier by rotatably driving the substantially rigid mandrel about its longitudinal axis to wind a resin-impregnated fibrous tape around the moisture barrier.

13. A method as claimed in claim 12, wherein, over a part of the length of the mandrel adjacent each of its ends, several layers of resin-impregnated fibrous tape are applied to form end parts of an external diameter greater than the remaining part of its length and, after the waveguide has been removed from the mandrel, said end parts are formed into a shape and size suitable for effecting a joint with an end of another waveguide.

14. A method as claimed in claim 13, wherein one end part of the waveguide is introduced into and is a tight fit in one end of a substantially rigid sleeve having a bore of complementary cross-section, the other end of the sleeve being adapted to receive an end part of another waveguide.

15. A method as claimed in claim 1, wherein the waveguide is removed from the substantially vertical mandrel by maintaining the mandrel stationary and pushing the waveguide downwards off the mandrel into a substantially vertical hole in the floor beneath the mandrel.

16. A method as claimed in claim 1, wherein, in passing from the wire-winding station to the curing station, the mandrel passes through at least two stations at each of which at least one layer of resin-impregnated reinforcing elements is formed over the layer of wire.

17. Apparatus for use in the manufacture of a substantially rigid electromagnetic waveguide, which apparatus comprises an overhead track; a plurality of carriages adapted to travel along the track and each having means for supporting an elongate mandrel with its axis substantially vertical; and, at spaced positions along the route of and below the overhead track, a wire-winding station at which apparatus is provided for helically winding a layer of wire on to a mandrel, at least one station at which apparatus is provided for forming on a layer of wire on a mandrel at least one layer of resin-impregnated reinforcing elements, a curing station at which apparatus is provided for curing the layer or layers of resin-impregnated reinforcing elements on at least one mandrel, and an extraction station at which apparatus is provided for removing a waveguide from a mandrel.

18. Apparatus for use in the manufacture of a substantially rigid electromagnetic waveguide, which apparatus comprises an overhead track; a plurality of carriages adapted to travel along the track and each having means for supporting an elongate mandrel with its axis substantially vertical; and, at spaced positions along the route of and below the overhead track, a wire-winding station at which apparatus is provided for helically winding a layer of wire on to a mandrel, at least one station at which apparatus is provided for forming on a layer of wire on a mandrel at least one layer of resin-impregnated reinforcing elements, a station at which apparatus is provided for applying over the layer or outermost layer of resin-impregnated reinforcing elements a moisture barrier, a station at which there is provided apparatus for applying over said moisture barrier an outer protective covering, a curing station at which apparatus is provided for curing the layer or layers of resin-impregnated reinforcing elements and, if necessary, the outer protective covering of at least one mandrel, and an extraction station at which apparatus is provided for removing a waveguide from a mandrel.

19. Apparatus as claimed in claim 17, wherein the apparatus includes, between the wire-winding station and the station, or the first of the stations, at which a layer of resin-impregnated reinforcing elements can be formed, a station at which apparatus is provided for warming a mandrel or mandrels carrying a layer of helically wound wire.

20. Apparatus as claimed in claim 17, wherein the overhead track is endless.

21. Apparatus as claimed in claim 19, wherein the apparatus includes, between the extraction station and the wire-winding station, a station at which means is provided for cleaning a mandrel.

22. Apparatus as claimed in claim 18, wherein at each of the wire-winding station, the station or stations at which a layer or layers of resin-impregnated reinforcing elements can be formed, the station at which a moisture barrier can be applied and the station at which an outer protective covering can be applied, means is provided for holding a mandrel substantially rigid but rotatable during the operation to be effected at said station.

23. Apparatus as claimed in claim 22, wherein at each of said stations the means for holding a mandrel substantially rigid comprises a fixed upper spigot dependent from the overhead track and, in axial alignment with and spaced below the fixed spigot, a lower spigot whose position is vertically adjustable, each spigot being adapted to engage in one end of a substantially vertical tubular mandrel.

24. Apparatus as claimed in claim 23, wherein each lower spigot is of such a form that, when engaged in one end of a substantially vertical tubular mandrel, relative rotational movement between the spigot and the mandrel is prevented and wherein means is provided for rotatably driving the lower spigot about its axis.

25. Apparatus as claimed in claim 22 wherein at each of the wire-winding station, the station or at least one of the stations at which the layer or layers of resin-impregnated reinforcing elements can be formed and the station at which an outer protective covering can be applied, there is provided at least one substantially vertical shaft, extending between the floor and the overhead track, a support which is mounted on the shaft or shafts and which carries the apparatus of said station, and means for driving said support up and down said shaft or shafts.

26. Apparatus as claimed in claim 18, wherein at the station at which a moisture barrier can be applied there is provided a table so pivoted about a substantially horizontal axis that the table can be arranged to be substantially vertical with its surface tangential to a substantially vertical mandrel at said station, pneumatic means for maintaining a metallic sheet against the surface of the table, and means for guiding the substantially vertically disposed table in a direction tangential to the mandrel.

27. Apparatus as claimed in claim 17, wherein the apparatus at the extraction station comprises a substantially vertical hole in the floor so positioned that it will be beneath a substantially vertical mandrel when at said station, an ejector adapted to engage the upper end of a waveguide formed on a mandrel, and means for driving said ejector vertically downwards with respect to the mandrel to push the waveguide downwards off the mandrel into the substantially vertical hole in the floor.

* * * * *